US005881682A

United States Patent [19]

Hirose et al.

[11] Patent Number: 5,881,682

[45] Date of Patent: Mar. 16, 1999

[54] HEAT GENERATOR FOR AUTOMOTIVE VEHICLES

[75] Inventors: Tatsuya Hirose; Takashi Ban; Shigeru Suzuki; Tatsuyuki Hoshino, all of Kariya, Japan

[73] Assignee: Kabushiki Kaisha Toyoda Jidoshokki Seisakusho, Kariya, Japan

[21] Appl. No.: 881,877

[22] Filed: Jun. 24, 1997

[30] Foreign Application Priority Data

Jun. 27, 1996 [JP] Japan ..... 8-167510

[51] Int. Cl.[6] ..... F22B 3/06

[52] U.S. Cl. ..... 122/26; 123/142.5; 237/12.3 R

[58] Field of Search ..... 122/26; 123/142.5; 237/12.3 R

[56] References Cited

U.S. PATENT DOCUMENTS

| | | | |
|---|---|---|---|
| 5,573,184 | 11/1996 | Martin | 122/26 |
| 5,755,379 | 5/1998 | Ito | 237/12.3 R |
| 5,775,583 | 7/1998 | Braatz et al. | 237/12.3 |
| 5,778,843 | 7/1998 | Inoue et al. | 123/142.5 |

*Primary Examiner*—Teresa Walberg
*Assistant Examiner*—Gregory A. Wilson
*Attorney, Agent, or Firm*—Morgan & Finnegan, L.L.P.

[57] ABSTRACT

A heat generator is disclosed that has its driving state constantly monitored and can be disconnected from a power source after an abnormality of its drive mechanism is detected. A plurality of holes are formed at equal angular intervals along the periphery of a disk-shaped rotor, which is capable of rotating in unison with a drive shaft. A magnetic sensor is mounted in a rear housing in a manner opposed to the holes. The drive shaft is selectively connected to the outer drive source via an electromagnetic clutch. A closed magnetic circuit, which is formed in the heat generator by magnetic flux leakage from the electromagnetic clutch, extends through the rotor and the magnetic sensor. When the rotor is rotating normally, the magnetic flux is periodically disturbed by the holes, and the magnetic sensor outputs a pulse signal indicative of the sensed periodic disturbance of the magnetic flux. On the other hand, when the rotor stops rotating due to an abnormality occurring in the rotor drive system, the disturbance of magnetic flux by the holes disappears, and the pulse signal from the sensor ceases. In this case, the drive shaft is disengaged from the power source.

8 Claims, 5 Drawing Sheets

HEAT GENERATOR FOR AUTOMOTIVE VEHICLES

BACKGROUND OF THE INVENTION

1. Field of the Invention

The present invention relates to a viscous fluid heat generator, and more particularly, to a viscous fluid heat generator that includes a rotary assembly, which can be selectively connected to an external drive source via an electromagnetic clutch.

2. Description of the Related Art

Heat generators that are driven by a vehicle engine have attracted attention as an auxiliary heat source. This kind of heat generator includes a housing, a drive shaft extending through the housing and driven by the engine, and a rotor received in the housing and operatively connected to the drive shaft. Further, the heat generator has a heat-generating chamber defined within the housing, which accommodates the rotor and is filled with a required amount of a viscous fluid. The rotor shears the viscous fluid held between an inner wall surface of the heat-generating chamber and an outer surface of the rotor itself to generate frictional heat by fluid friction.

The drive shaft of the heat generator is connected to a pulley directly or by way of an electromagnetic clutch mechanism. Further, auxiliary machines for the vehicle, other than the heat generator, are also provided with respective pulleys on which power transmission belts extend. Engine output torque is distributed to the heat generator and other auxiliary machines via the power transmission belts.

However, if the drive shaft and the rotor are locked due to some malfunction of the drive mechanism of the heat generator, it will be impossible for the pulley of the heat generator to be driven. In such a case, the power transmission belt slips on the heat generator pulley, and vibrations caused by the slipping of the power transmission belt are transmitted to other auxiliary machines, resulting in noise.

It is an object of the present invention to provide a heat generator that has its driving state constantly monitored and that can be disconnected from a power transmission system of an external power immediately after an abnormality of its drive mechanism is detected.

SUMMARY OF THE INVENTION

Broadly speaking, the present invention relates to a heat generator for an automotive vehicle, which includes a rotor, which forms part of a rotary assembly, a housing, a heat-generating chamber defined in the housing containing a viscous fluid, and a heat-receiving chamber defined in the housing for permitting a circulating fluid to flow therethrough. The rotary assembly is selectively connected to an external drive source by an electromagnetic clutch. Heat is generated by shearing of the viscous fluid by rotation of the rotor, and the generated heat is transferred to the circulating fluid flowing through the heat-receiving chamber. Further, the heat generator includes at least one magnetic flux-disturbing element and a magnetic flux change-detecting sensor. The magnetic flux-disturbing element is formed in a portion of the rotary assembly. With rotation of the rotary assembly, the magnetic flux-disturbing element crosses a closed magnetic circuit, which is formed by a magnetic flux leakage flowing from the electromagnetic clutch at least through the rotary assembly and causes changes in the magnetic flux along the closed magnetic circuit. The magnetic flux change-detecting sensor is arranged along the closed magnetic circuit. This magnetic flux change-detecting sensor detects changes in the magnetic flux caused by the magnetic flux-disturbing element and supplies a signal indicative of the sensed change.

According to the heat generator of the present invention, the rotary assembly incorporating the rotor is connected to the external drive source via the electromagnetic clutch. Therefore, so long as the rotary assembly rotates normally, the magnetic flux-disturbing element crosses the closed magnetic circuit formed by the magnetic flux leakage with a certain regularity. For instance, when the rotary assembly is rotating at a constant speed (constant angular velocity), the magnetic flux-disturbing element crosses the closed magnetic circuit at a fixed repetition period. This disturbs the magnetic flux flowing along the closed magnetic circuit with a certain regularity, and accordingly, the magnetic flux density changes in response to the disturbance of the magnetic flux. Therefore, so long as the change in the magnetic flux sensed by the magnetic flux change-detecting sensor is within a range of expected regularity, it can be judged that the rotary assembly is rotating normally.

On the contrary, if there is any malfunction in the drive mechanism of the heat generator, the rotation of the rotary assembly will become abnormal or will stop, and the regularity with which the magnetic flux-disturbing element crosses the closed magnetic circuit will not continue. In such a case, the change in the magnetic flux detected by the magnetic flux change-detecting sensor departs from the range of expected regularity, and it can be judged from the signal delivered from the magnetic flux change-detecting sensor that there is some abnormality in the drive mechanism of the heat generator.

It is preferable that the heat generator according to the present invention is also provided with a control device for controlling operation of the electromagnetic clutch in response to the signal from the magnetic flux change-detecting sensor. The control device controls the operation of the electromagnetic clutch properly according to the state of the heat generator.

According to the heat generator of the present invention, the magnetic flux change-detecting sensor outputs a pulse signal, which varies according to periodic changes in the magnetic flux, while the control device described above senses abnormal rotation of the rotary assembly from the pulse signal to thereby control the transmission of torque between the rotary assembly and the external drive source by way of the electromagnetic clutch.

According to the heat generator of the present invention, the rotary assembly includes, in addition to the rotor, at least a drive shaft and a clutch disk. In this case, the clutch disk smoothly establishes selective connection of the rotary assembly with the electromagnetic clutch and the external drive source.

Preferred embodiments of the magnetic flux-disturbing elements as well as features and advantages thereof will become more apparent from the following detailed description. However, it should be noted that it is particularly preferred that the magnetic flux-disturbing elements are holes or notches formed in the rotor. In this case, the viscous fluid around the rotor can flow through these holes or notches to easily circulate within the heat-generating chamber. Consequently, pressure distribution of the viscous fluid around the rotor is made as uniform as possible, so that the rotation of the rotor, and that of the rotary assembly incorporating the rotor are stabilized.

The present invention can be implemented in numerous ways, including as an apparatus or as a method.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE PREFERRED EMBODIMENTS

The present invention will now be described in detail with reference to the drawings. The heat generator of the preferred and illustrated embodiment is incorporated in a heating system for an automotive vehicle.

Figure 1:
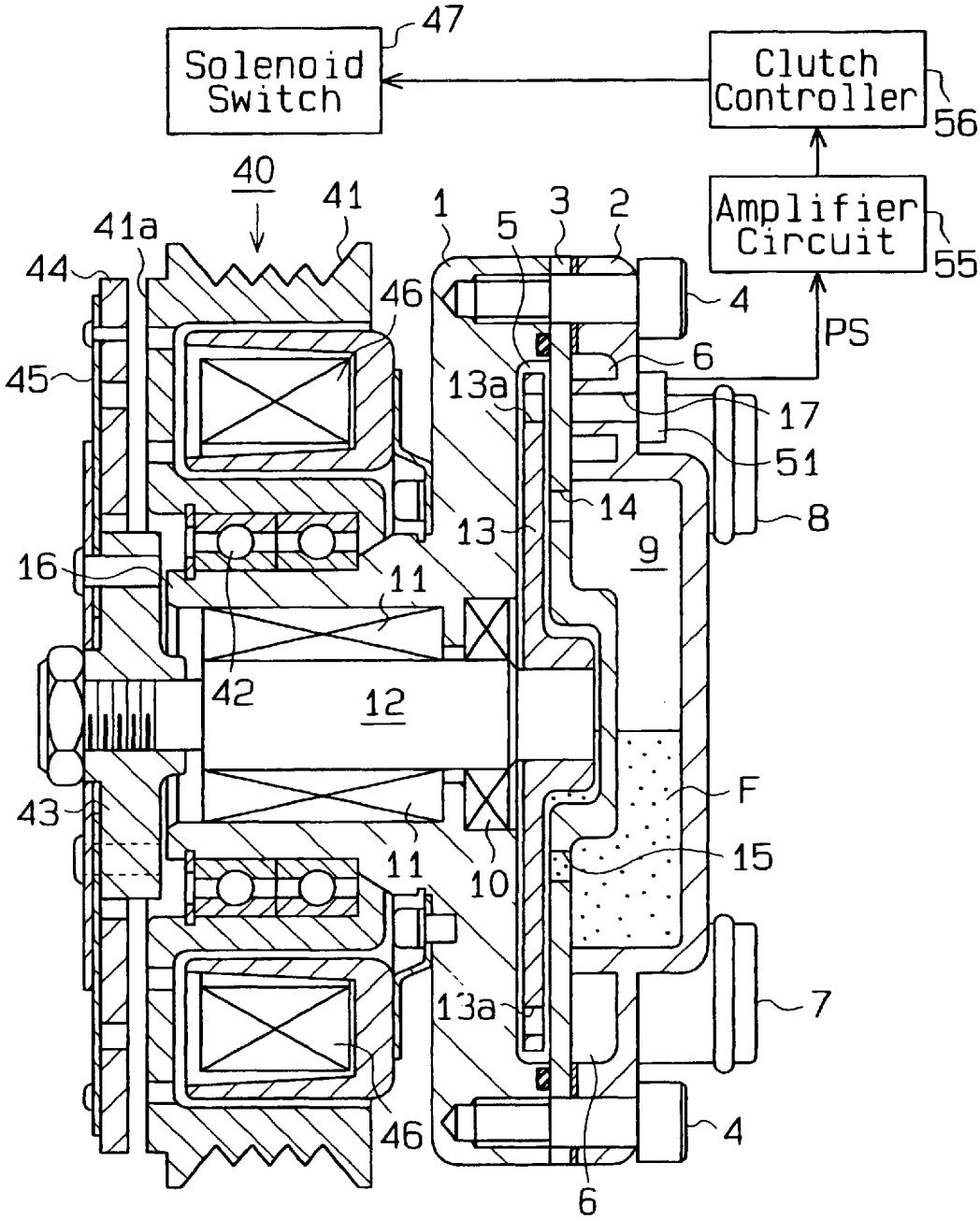
FIG. 1 is a longitudinal sectional view of a heat generator according to one embodiment of the present invention.

Referring first to FIG. 1, the heat generator includes a front housing 1, a rear housing 2 and a separator plate 3. The separate plate 3 has a high thermal conductivity and is arranged between the two housings 1 and 2. The front and rear housings 1 and 2 are fastened to each other by a set of iron bolts 4 with the separator plate 3 located therebetween.

The rear side of the front housing 1 (the right side in FIG. 1) has a recess, which cooperates with a flat front-side surface of the separator plate 3 to define a heat-generating chamber 5 therebetween. Between an outer peripheral portion of the rear surface of the separator plate 3 and the rear housing 2 is a water jacket 6 serving as a heat-receiving chamber, which is adjacent to the heat-generating chamber 5. A water intake port 7 and a water outlet port 8 are formed in radially outer portions of a rear wall of the rear housing 2. The water intake port 7 takes in circulating fluid from a heating circuit (not shown). As the circulating fluid, engine coolant, for instance, is used. The circulating fluid circulates within the water jacket 6 and then flows from the water outlet port 8 to the heating circuit. Thus, the water jacket 6 forms part of the heating circuit of the automotive vehicle to form a circulating path for the circulating fluid.

Between a radially inner portion of the rear surface of the separator plate 3 and the rear housing 2, there is an auxiliary oil chamber 9 serving as a reservoir. A recovery passage 14 and a supply passage 15 are formed in the separate plate 3 for communicating the heat-generating chamber 5 with the auxiliary oil chamber 9.

A drive shaft 12 is rotatably supported in the front housing 1 by a radial bearing 11. Further, in the front housing 1, an oil seal 10 is located adjacent to the heat-generating chamber 5, so that both the heat-generating chamber 5 and the auxiliary oil chamber 9 are tightly sealed with the rear end portion of the drive shaft 12 extending into the heat-generating chamber 5. The drive shaft 12 has a disk-shaped rotor 13 fixed to the rear end portion of the drive shaft 12. The rotor 13 is made of iron and occupies the heat-generating chamber 5.

The heat-generating chamber 5 and the auxiliary oil chamber 9 contain a required amount of silicone oil F as a viscous fluid. The recovery passage 14 has an outlet end opening into the auxiliary oil chamber 9 at a location above an upper level of the viscous fluid F in the auxiliary oil chamber 9, while the supply passage 15 has an inlet end opening into the auxiliary oil chamber 9 at a location below the upper level of the viscous fluid F in the auxiliary oil chamber 9. The recovery passage 14 is formed at a predetermined distance from the rotational axis of the rotor 13. As the rotor 13 rotates in unison with the drive shaft 12, the silicone oil is caused to fill the space between an inner wall surface of the heat-generating chamber 5 and an outer surface of the rotor 13 due to the high viscosity of the oil. With rotation of the rotor 13, part of the viscous fluid F within the heat-generating chamber 5 is returned via the recovery passage 14 into the auxiliary oil chamber 9, while the viscous fluid F within the auxiliary oil chamber 9 is supplied via the supply passage 15 into the heat-generating chamber 5 with the help of the weight of the viscous fluid itself. Thus, the viscous fluid F in the heat-generating chamber 5 is replaced by the viscous fluid F in the auxiliary oil chamber 9 at a certain rate.

An electromagnetic clutch 40 is arranged in the vicinity of the front end of the drive shaft 12 and a sleeve 16 projecting forward from the front housing 1. The electromagnetic clutch 40 includes a pulley 41, which is rotatably supported on the sleeve 16 via an angular bearing 42, and a clutch disk 44, which is slidably fitted on a support ring 43. The support ring 43 is fixed to the outer end of the drive shaft 12. A plate spring 45 is arranged on the front surface of the clutch disk 44. The plate spring 45 has a central portion fixed to the support ring 43 and radially outer end portions (upper and lower end portions as viewed in FIG. 1) riveted to a peripheral portion of the clutch disk 44. The clutch disk 44 is arranged such that its rear surface faces toward a front end face 41*a* of the pulley 41, and the front end face 41*a* serves as another clutch disk. The drive shaft 12, the rotor 13, the support ring 43, the clutch disk 44 and the plate spring 45 form a rotary assembly.

The pulley 41 and auxiliary machines (e.g., a compressor for an air conditioning system) other than the heat generator are connected by power transmission belts (not shown) to an automotive engine as an external drive source. Further, the front housing 1 supports an annular solenoid coil 46. The solenoid coil 46, which is received in a portion of the pulley 41 at a location between the outer periphery of the pulley 41 and the angular bearing 42, exerts electromagnetic force on the clutch disk 44 via the front end face 41*a* of the pulley 41.

Figure 2:
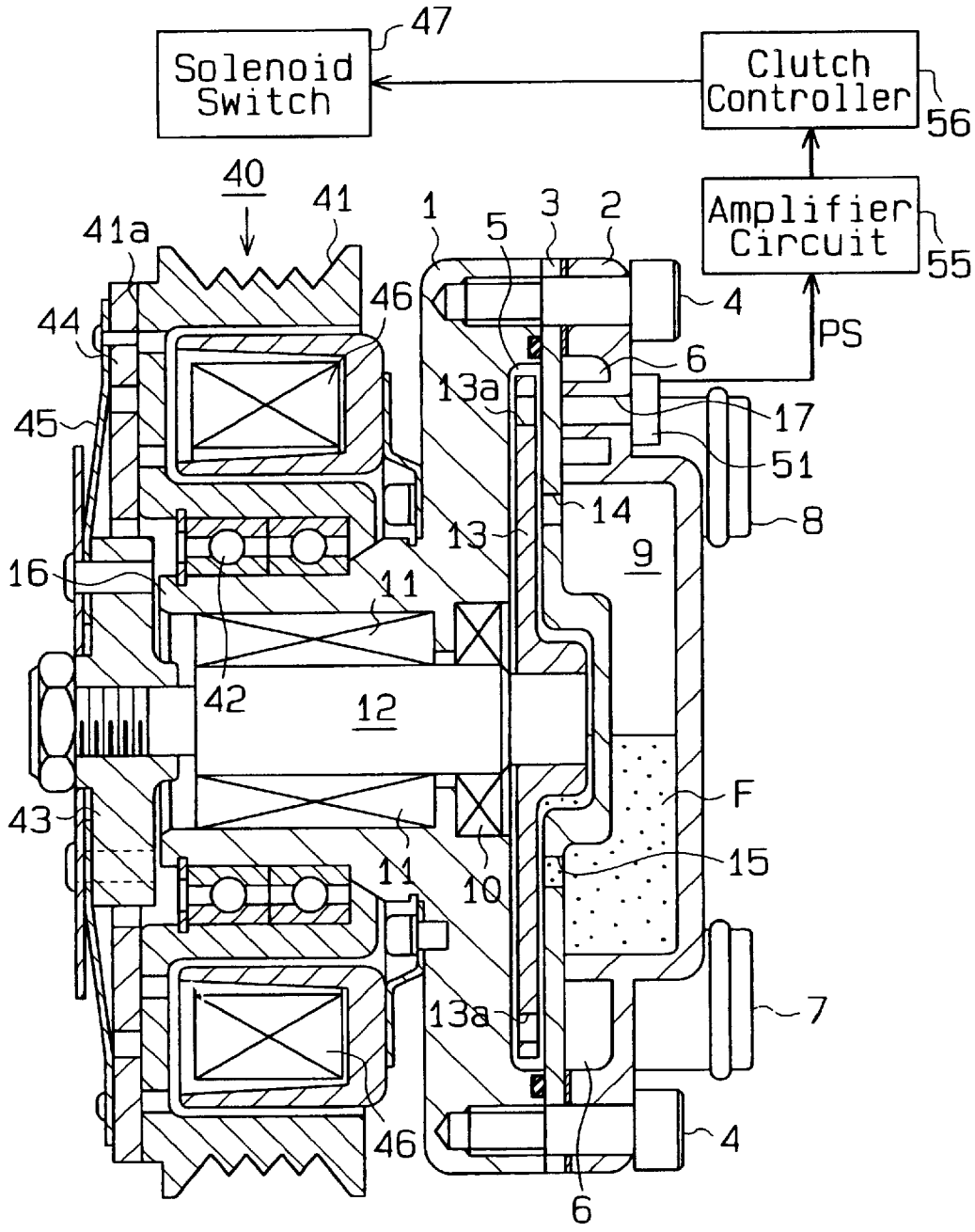
FIG. 2 is a longitudinal sectional view of the heat generator with the clutch engaged.

The solenoid coil 46 is connected to a power source (not shown) via a solenoid switch 47. When the solenoid switch 47 is turned on to energize the solenoid coil 46, the electromagnetic force generated by the solenoid coil 46 attracts and connects the clutch disk 44 to the end face 41*a* of the pulley 41 against the force of the plate spring 45, as shown in FIG. 2. When the clutch disk 44 is connected to the pulley 41, torque of the pulley 41 (i.e., torque of the engine) is transmitted to the drive shaft 12 via the clutch disk 44 and the support ring 43 for rotating the rotor 13. With rotation of the rotor 13, the silicone oil is sheared in the space between the inner wall surface of the heat-generating chamber 5 and the outer surface of the rotor 13 to generate heat. This heat is transferred via the separator plate 3 to the circulating fluid in the water jacket 6, and the heated circulating fluid is supplied via the heating circuit (not shown) to the air conditioning system for heating a passenger compartment of the automotive vehicle.

On the other hand, when the solenoid switch 47 is turned off to thereby deenergize the solenoid coil 46, the electromagnetic force of the pulley 46 disappears, and, as shown in FIG. 1, the clutch disk 44 is moved away from the side end face 41*a* of the pulley 41 by the force of the plate spring 45. Thus, the transmission of torque from the pulley 41 to the drive shaft 12 is cut off, and the rotor 13 stops shearing the silicone oil.

Figure 4:
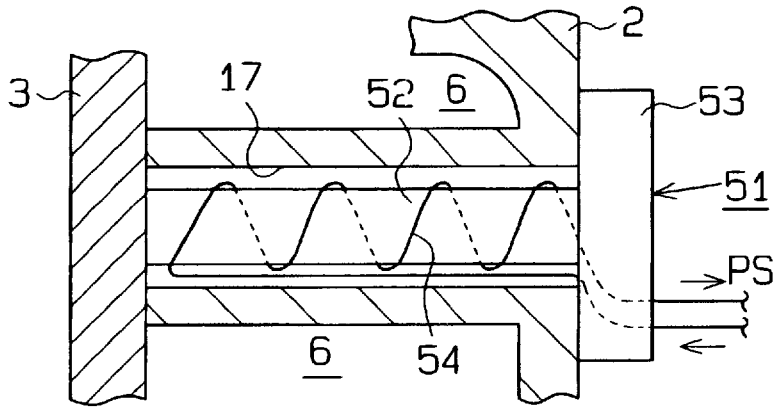
FIG. 4 is a fragmentary sectional view showing essential parts of a magnetic sensor mounted in the heat generator.

As shown in FIGS. 1 and 4, a magnetic sensor 51, serving as a magnetic flux change-detecting sensor, is arranged within a recess 17 formed in the rear housing 2. The recess 17 is formed in the vicinity of the upper bolt 4 appearing in FIG. 1, and the magnetic sensor 51 is arranged to extend substantially parallel with the bolt 4. The magnetic sensor 51 has an iron body, which is comprised of a rod 52 and a head 53, and a signal line 54, which is helically wound around the rod 52 of the sensor body. The signal line 54 is connected to a clutch controller 56 via an amplifier circuit 55, while the clutch controller 56 is connected to the solenoid switch 47.

The clutch controller 56 is a control unit, which is comprised of an input/output interface including an A/D converting circuit for digitizing analog signals and a processing circuit including a CPU, a ROM and a RAM. The clutch controller 56 operates based on predetermined programs, which are stored in the ROM, to determine and process digital data. In the present embodiment, the solenoid switch 47 and the clutch controller 56 form a control device for controlling the operation of the electromagnetic clutch 40.

Figure 3:
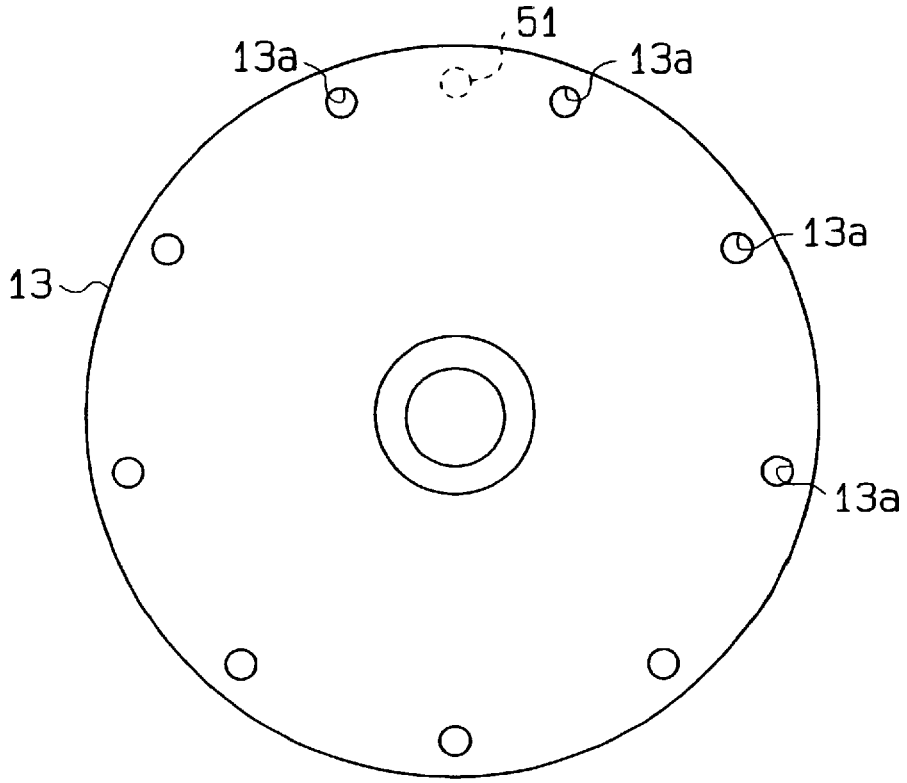
FIG. 3 is a front view of a rotor.

As shown in FIGS. 1 and 3, a plurality of holes 13*a*, which serve as magnetic flux-disturbing elements, are formed through a peripheral portion of the rotor 13. The holes 13*a* are arranged at equal angular intervals at an identical distance from the center of the rotor 13. The distance between the center of the rotor 13 and each of the holes 13*a* is approximately equal to the distance from the central axis of the rotor 13 to the magnetic sensor 51. Consequently, as the rotor 13 rotates, the holes 13*a* pass before the front side of the magnetic sensor 51, one after another.

When the solenoid switch 47 is turned on to energize the solenoid coil 46, the solenoid coil 46 generates a magnetic force for attracting the clutch disk 40 (see FIG. 2). On the other hand, magnetic flux leakage from the electromagnetic clutch 40 forms a closed circuit in which the magnetic flux leakage flows through the drive shaft 12, the rotor 13, the rod 52 and the head 53 of the magnetic sensor 51 and then returns to the solenoid coil 46 via the bolt 4. In this state, as the rotor 13 rotates at a constant speed, the holes 13*a* formed through the rotor 13 pass before the front side of the magnetic sensor 51 periodically one after another. That is, the holes 13*a* formed through the rotor 13 and the solid portions of the outer periphery of the rotor 13 alternately cross a portion of the closed magnetic circuit described above. Whenever one of the holes 13*a* or an adjacent one of the solid portions of the rotor 13 crosses the closed magnetic circuit, the magnetic flux along the closed magnetic circuit is disturbed, and at least in the vicinity of the magnetic sensor 51, distinctive periodic changes in the magnetic flux density take place. In response to the periodic changes in magnetic flux density, the magnetic sensor 51 outputs a periodic pulse signal PS.

The pulse signal PS from the magnetic sensor 51 is supplied to the clutch controller 56 via the amplifier circuit 55. The clutch controller 56 executes ON-OFF control of the solenoid switch 47 in response to changes in the pulse signal PS. For example, if the number of pulses of the pulse signal PS per unit time is below a predetermined value (including a case of stoppage of the pulse signal PS) in spite of the solenoid switch 47 being in the ON state, it is judged that there is an abnormality in either the rotor 13 or the drive system. In this case, the solenoid switch 47 is immediately turned off, whereby the drive shaft 12 and the pulley 41 are disconnected from each other.

On the other hand, so long as the number of pulses of the pulse signal PS per unit time is equal to or larger than the predetermined value and within an acceptable range of the number of pulses, operation of the rotor 13 and the drive system is judged to be normal. Then, the clutch controller 56 holds the solenoid switch 47 in the ON state such that the driving force of the engine is transmitted to the drive shaft 12 via the pulley 41 and the electromagnetic clutch 40.

The following are advantages of the disclosed heat generator.

When non-rotation or abnormal rotation of the rotor 13 is detected based on the pulse signal PS from the magnetic sensor 51, the electromagnetic clutch 40 can be disengaged to disconnect the drive shaft 12 from the pulley 41. Therefore, it is possible to prevent the power transmission belt from sliding on the locked or malfunctioning pulley 41 to prevent or control abnormal vibration transmitted by the power transmission belt.

Since the rotor 13 is made of iron, it is easily magnetized by the magnetic flux leakage from the electromagnetic clutch 40, which makes it possible to increase the density of the magnetic flux leakage in the closed magnetic circuit and thereby increase the voltage amplitude of the pulse signal PS. This enables the A/D converting circuit in the clutch controller 56 to clearly and readily discriminate between the H level and the L level of the pulse signal PS, which enhances reliability of the control system of the electromagnetic clutch 40.

The viscous fluid on the front and rear sides of the rotor 13 is permitted to flow in and out via the holes 13*a* formed through the body of the rotor 13. Therefore, differential pressure does not develop between the viscous fluid on the front side of the rotor 13 and that on the rear side of the rotor 13, which ensures stable rotation of the rotor 13. In addition, as the holes 13*a* are formed, the rotor body is provided with a plurality of circular edges formed on both surfaces thereof. These edges enhance the shearing capability of the rotor 13, which contributes to the heating efficiency of the heat generator. Further, the holes 13*a* are each capable of containing gasses, such as air and the like, which is inevitably mixed with the viscous fluid. This enables the heat generator to make efficient use of the heating space between the rotor 13 and the inner wall of the heat-generating chamber 5.

In the heat generator of the present embodiment, the rear housing 2 is provided with the magnetic sensor 51, while the rotor 13 is simply formed with the holes 13*a* which are relatively easy to form. Therefore, the rotor 13 does not have a complicated structure, which makes the increase in manufacturing costs of the rotor 13 very small.

Although only one embodiment of the present invention has been described so far, it should be apparent to those skilled in the art that the present invention may be embodied in many other specific forms without departing from the spirit or scope of the invention. Particularly, it should be understood that the invention may be embodied in the following forms.

Figure 5:
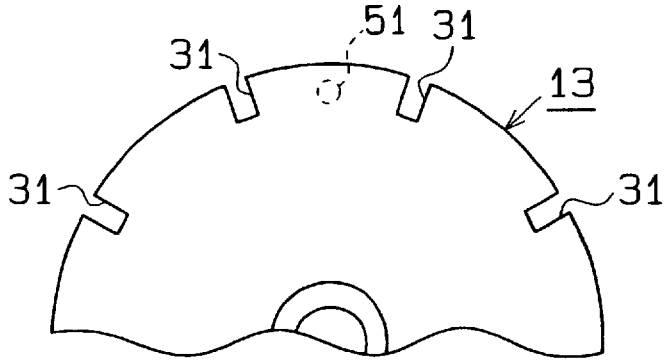
FIG. 5 is a fragmentary front view of a variation of the rotor.

As shown in FIG. 5, in place of the holes 13*a* of the rotor 13, a plurality of notches 31 may be formed on the outer periphery of the rotor 13 as magnetic flux-disturbing elements. In this case, as the rotor 13 rotates, the notches 31 pass before the front side of the magnetic sensor 51, so that the same effect as obtained by the holes 13*a* can be obtained. Further, since the front and rear sides of the rotor 13 are communicated with each other via the notches 31, pressure distribution of the viscous fluid around the rotor 13 is made uniform.

Figure 6A:
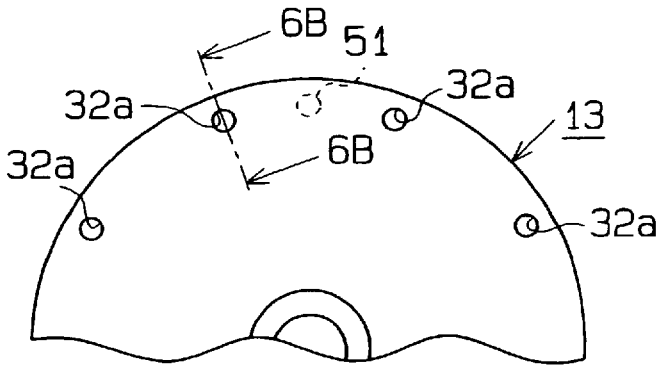
FIG. 6A is a fragmentary front view of a further variation of the rotor.
Figure 6B:
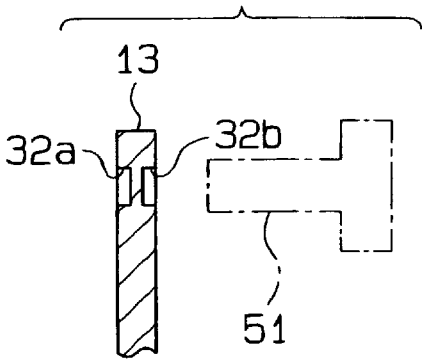
FIG. 6B is a view taken along the line 6B—6B of FIG. 6A.

As shown in FIGS. 6A and 6B, a pair of recesses 32*a* and 32*b* may be formed as magnetic flux-disturbing elements at a location corresponding to each of the holes 13*a*, such that the recess 32*a* opens in the front surface of the rotor 13, and the recess 32*b* opens in the rear surface at the same location. The location at which the pair of back to back recesses 32*a* and 32*b* are formed is relatively thin compared with the thickness of the rotor body. In this case as well, as the rotor rotates, the recesses 32*a*, 32*b* disturb the magnetic flux in the closed magnetic circuit according to the depth thereof. Therefore, the recesses 32*a* and 32*b* cause periodic changes in the magnetic flux through the magnetic sensor 51 in the same manner as the holes 13*a* formed through the rotor 13, according to rotation of the rotor 13.

Figure 7:
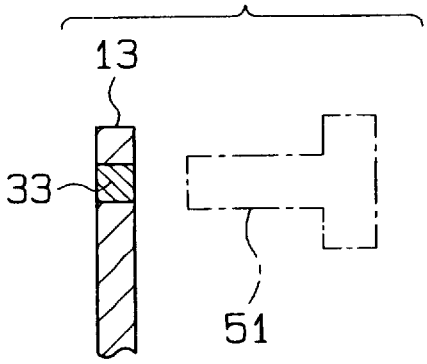
FIG. 7 shows an alternate embodiment viewed from the same direction as FIG. 6B.

As shown in FIG. 7, magnets 33 may be embedded as magnetic flux-disturbing elements in the holes 13*a* of the rotor 13, respectively. This also provides the same actions and effects as the embodiments described above. In addition, the magnets 33 are capable of reinforcing the magnetic flux leakage generated by the solenoid coil 46, which improves response of the magnetic sensor 51.

Figure 8:
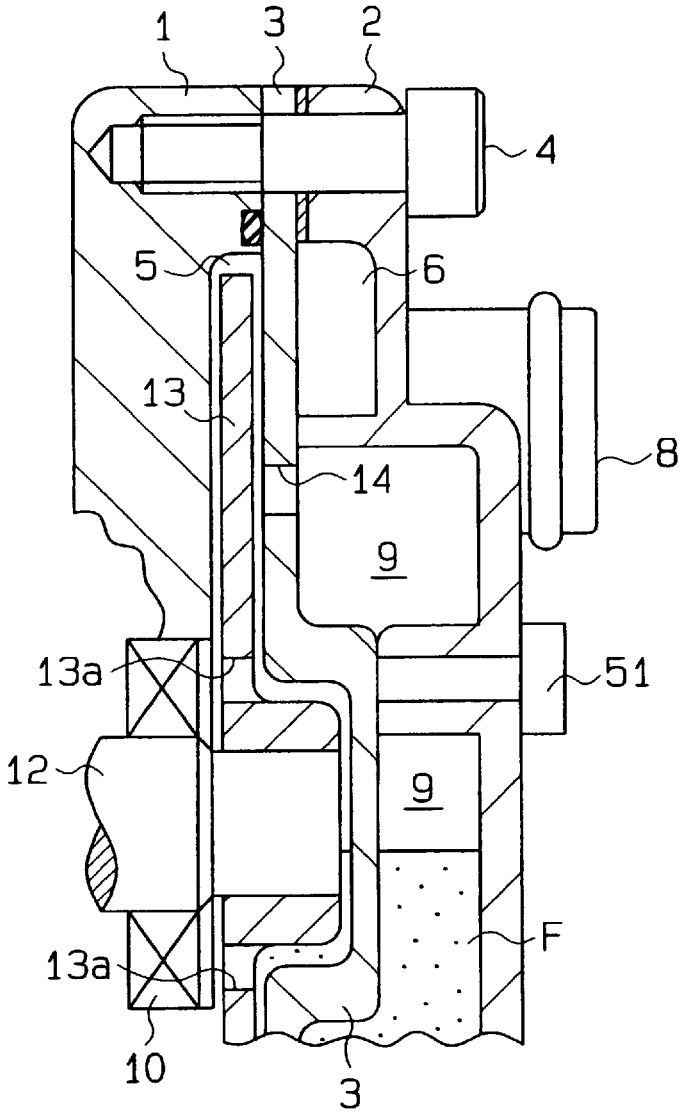
FIG. 8 is a partial cross-sectional view of a variation of the magnetic sensor mounted in the heat generator.

As shown in FIG. 8, the holes 13*a* as magnetic flux-disturbing elements may be formed at locations close to the center of the rotor 13, and at the same time the magnetic sensor 51 may be located such that it is opposed to each of the holes 13*a* as the rotor 13 rotates. Taking this idea even further, recesses as magnetic flux-disturbing elements may be formed on a peripheral portion of the rear end of the drive shaft 12.

The magnetic flux change-detecting sensor may be arranged at a location in the vicinity of the outer periphery of the rotor 13. Further, the bolt 4 may be used as the magnetic flux change-detecting sensor. In this case, if the bolt 4, the head of which has a signal line 54 wound around it, is arranged such that its head is on the solenoid coil 46 side, the bolt can serve as an iron core (i.e., like rod 52). As a result, the number of component parts of the heat generator is reduced, and assembly is simplified. Still further, if the magnetic flux change-detecting sensor is arranged between the solenoid coil 46 and the rotor 13, the length of loop of the closed magnetic circuit is shortened and the response of the sensor is improved.

Throughout the specification, the term "viscous fluid" is used to mean any kind of fluid that generates heat by fluid friction caused by the shearing action of the rotor, and hence the viscous fluid is not limited to liquid or high viscosity semi-fluid or to silicone oil.

Therefore, the present examples and embodiment are to be considered as illustrative and not restrictive and the invention is not to be limited to the details given herein, but may be modified within the scope and equivalence of the appended claims.

What is claimed is:

1. A heat generator for an automotive vehicle, which includes a rotor, which forms part of a rotary assembly, a housing, a heat-generating chamber defined in said housing containing a viscous fluid, and a heat-receiving chamber defined in said housing for permitting a circulating fluid to flow therethrough, said rotary assembly being selectively connected to an external drive source by an electromagnetic clutch, wherein heat is generated by shearing of said viscous fluid by rotation of said rotor, said generated heat being transferred to said circulating fluid flowing through said heat-receiving chamber, the heat generator further comprising:

magnetic flux-disturbing means formed in a portion of said rotary assembly for crossing a closed magnetic circuit, which is formed by a magnetic flux leakage flowing from said electromagnetic clutch at least through said rotary assembly as said rotary assembly rotates to thereby cause changes in said magnetic flux along said closed magnetic circuit; and a magnetic flux change-detecting sensor arranged along said closed magnetic circuit for detecting said changes in said magnetic flux caused by said magnetic flux-disturbing means and for supplying a signal indicative of the sensed changes.

2. The heat generator according to claim 1 further comprising control means for controlling operation of said electromagnetic clutch in response to said signal from said magnetic flux change-detecting sensor.

3. The heat generator according to claim 2, wherein said magnetic flux change-detecting sensor outputs a pulse signal in response to periodic changes in said magnetic flux, and wherein said control means senses abnormal rotation of said rotary assembly from the state of said pulse signal to thereby control transmission of torque between said rotary assembly and said external drive source by way of said electromagnetic clutch.

4. The heat generator according to claim 1, wherein said rotary assembly includes a drive shaft and a clutch disk.

5. The heat generator according to claim 1, wherein said magnetic flux-disturbing means includes at least one hole formed through said rotor.

6. The heat generator according to claim 1, wherein said magnetic flux-disturbing means includes at least one notch formed on said rotor.

7. The heat generator according to claim 1, wherein said magnetic flux-disturbing means includes at least one recess formed in said rotor.

8. The heat generator according to claim 1, wherein said magnetic flux-disturbing means includes at least one magnet embedded in said rotor.

* * * * *